US005409070A

United States Patent [19]

Roussy

[11] Patent Number: 5,409,070

[45] Date of Patent: Apr. 25, 1995

[54] COUPLING FOR ROTARY-VIBRATORY DRILLS

[76] Inventor: Raymond J. Roussy, 10241-148th Street, Surrey, British Columbia, Canada, V3R 6S4

[21] Appl. No.: 136,814

[22] Filed: Oct. 18, 1993

[51] Int. Cl.[6] ..... E02D 7/18

[52] U.S. Cl. ..... 173/49; 173/143; 175/55

[58] Field of Search ..... 173/49, 142, 143, 114; 175/55

[56] References Cited

U.S. PATENT DOCUMENTS 2,123,364 7/1938 Katterjohn ..... 173/143
2,776,113 1/1957 Reh ..... 173/49
3,467,207 9/1969 Pyles et al. ..... 173/49
3,786,874 1/1974 Jodet et al. ..... 173/49
3,866,693 2/1975 Century ..... 173/49
5,027,908 7/1991 Roussy ..... 173/49

*Primary Examiner*—Scott A. Smith
*Attorney, Agent, or Firm*—Norman M. Cameron

[57] ABSTRACT

A rotary-vibratory drill coupling has a first component with a plurality of spaced-apart members. Each member has a pair of opposed, spaced-apart faces defining a slot therebetween. A second component has a plurality of angularly spaced-apart blade-like projections extending radially thereon. Each of the projections is slidably received between one pair of the opposed, spaced-apart faces on the first component. Preferably there are anti-friction linings between the projections and the faces.

7 Claims, 4 Drawing Sheets

COUPLING FOR ROTARY-VIBRATORY DRILLS

BACKGROUND OF THE INVENTION

Field of the Invention

This invention relates to couplings particularly adapted for use on combination rotary-vibratory drills.

Description of Related Art

Combination rotary-vibratory drills are well adapted for many purposes including the taking of soil samples to test for minerals or soil contamination. Such drills usually employ a mechanical vibrator including one or more rotating eccentrics or rollers. These impart a vertical vibration to the drill string which may be in the sonic frequency range. If so, the drill is commonly known as a sonic drill. At the same time, the drill pipes are rotated by one or more motors.

Problems have been encountered in devising a coupling capable of connecting a rotating mechanism to the drill string while accommodating the vertical vibrations.

Prior attempts to transfer rotary motion to the drill have not been fully successful. Complicated linkages have been employed, but these have often failed under actual working conditions. Metal to metal splines have been tried but are often welded together due to the vibrations. Attempts to use keyways on the shaft would lead to similar problems with welding. Furthermore, the old linkages and gears were often exposed and noisy and subject to damage by weather.

Accordingly, there is a need for an improved coupling useful for connecting the rotating mechanism of a rotary-vibratory drill to the vibrating mechanism.

SUMMARY OF THE INVENTION

According to the invention, a rotary-vibratory drill coupling includes a first component having at least one member. Each member has a pair of opposed, spaced-apart faces defining a slot therebetween. There is a second component having at least one blade-like projection extending radially thereon. Each of the projections is received slidably between one said pair of the opposed, spaced-apart faces of the first component.

Preferably there are antifriction linings between the projections and the opposed faces. The linings may be of glass fiber reinforced PTFE for example.

DESCRIPTION OF THE PREFERRED EMBODIMENTS

Figure 1:
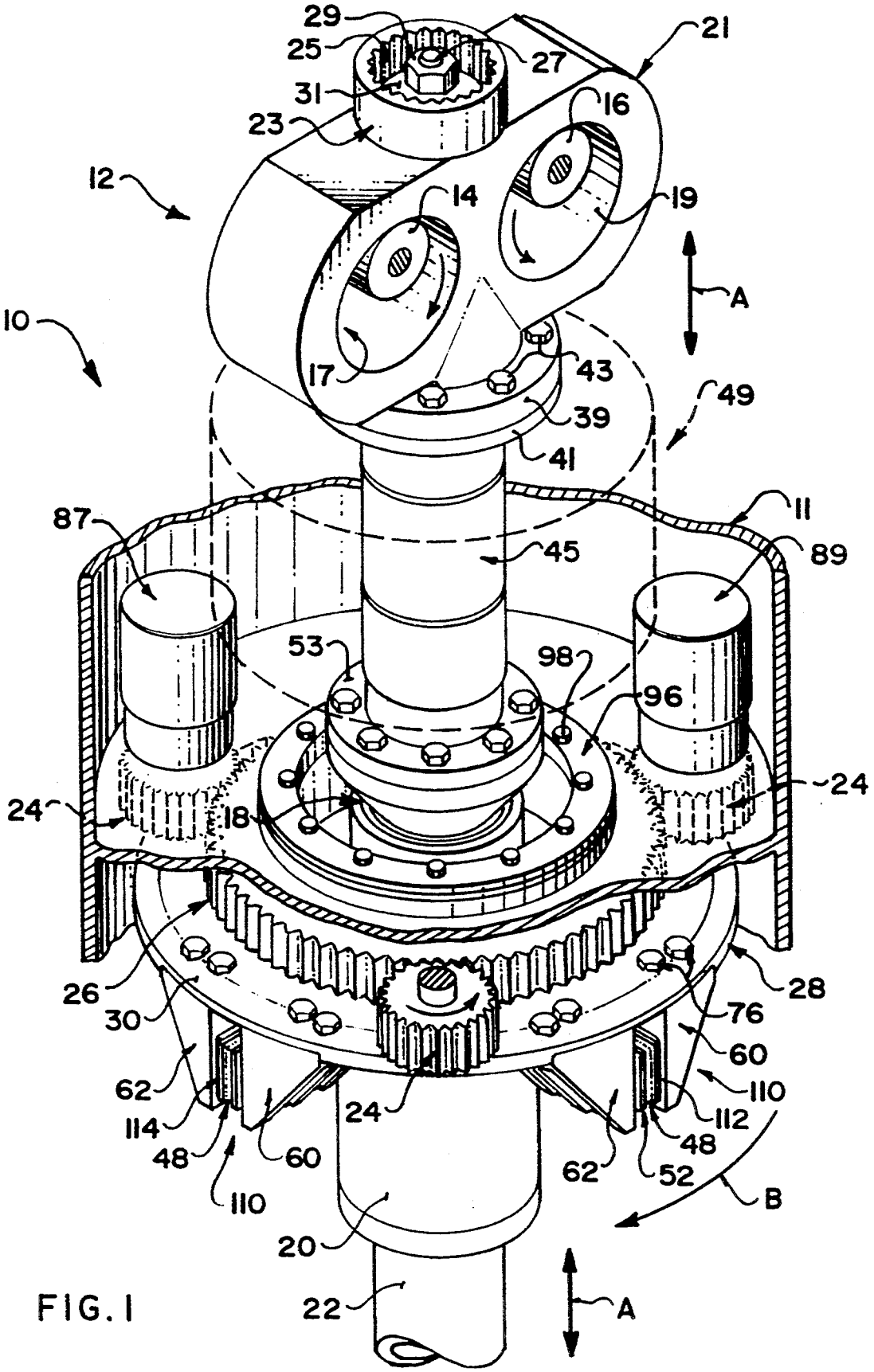
FIG. 1 is a fragmentary isometric view, partly broken away, of a rotary-vibratory drill equipped with a coupling according to the invention.
Figure 2:
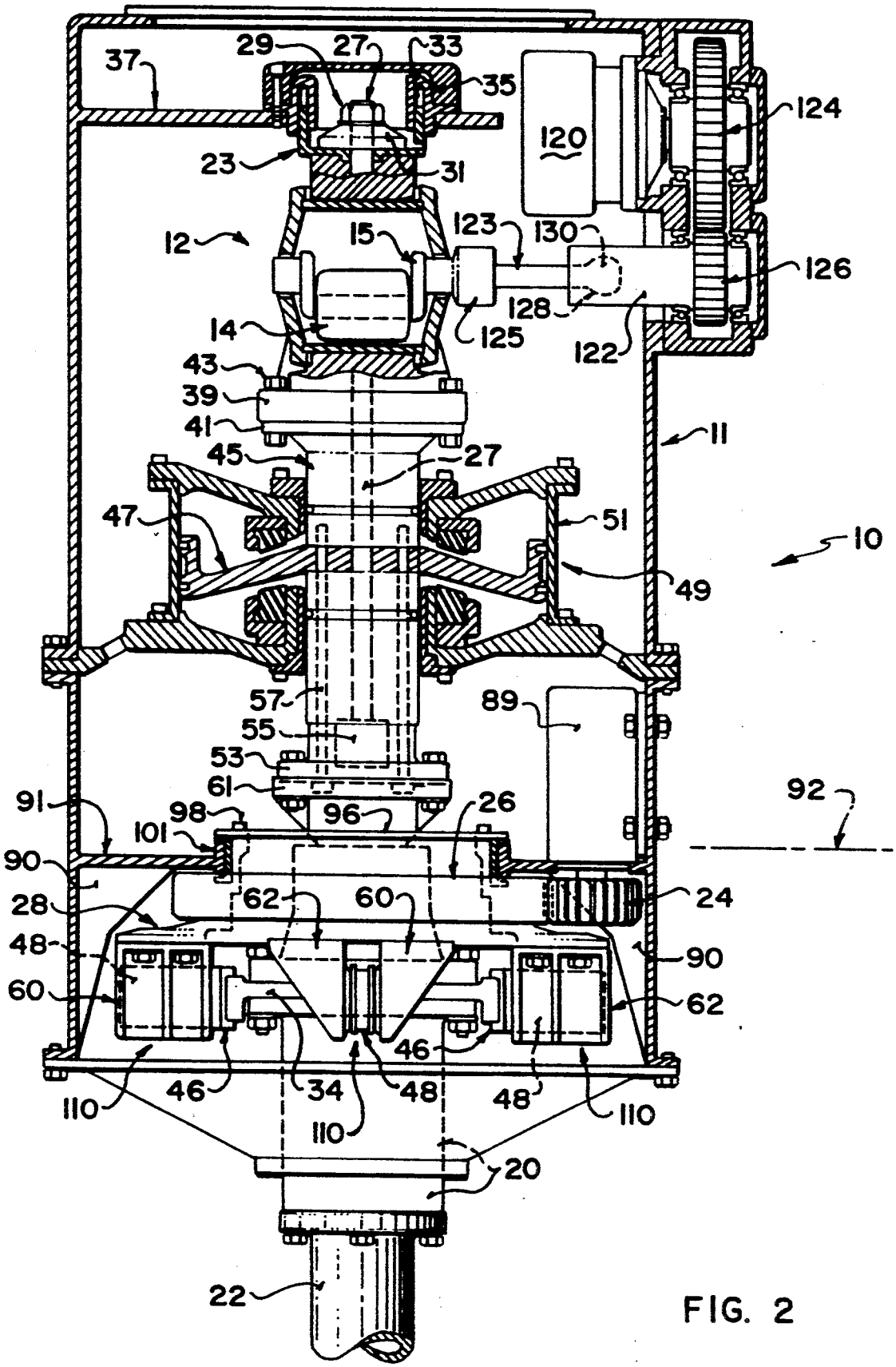
FIG. 2 is a side elevation, partly in section, thereof.

Referring to FIG. 1 and 2 these show rotary-vibratory drill at 10 which is generally similar to a type already known in the art and disclosed in my earlier U.S. Pat. No. 5,027,908 which is incorporated by reference.

The drill includes a cylindrical container 11 in which the vibrating and rotating mechanism are contained. The previously known components include vibrator 12 which includes a pair of counter rotating rollers 14 and 16 which impart vertical vibrations to the drill. The rollers rotate on cranks, such as crank 15 shown in FIG. 2, within cylindrical cavities 17 and 19 in a housing 21. In this particular example the vibrations are in the sonic range.

The vibrator 12 has a ring 23 with internal splines 25 mounted on top thereof by means of tensioning bolt 27, nut 29 and a washer 31. The ring 23 mates with corresponding splines within slot 33 of a member 35 shown in FIG. 2. Member 35 is mounted on a bracket 37 which is rigidly connected to container 11. The mating splines on the ring 23 and member 35 allow for up and down movement of the vibrator, as shown by arrow A in FIG. 1 along axis Y in FIG. 3, while the bracket 37 and member 35 prevent rotation thereof.

Figure 3:
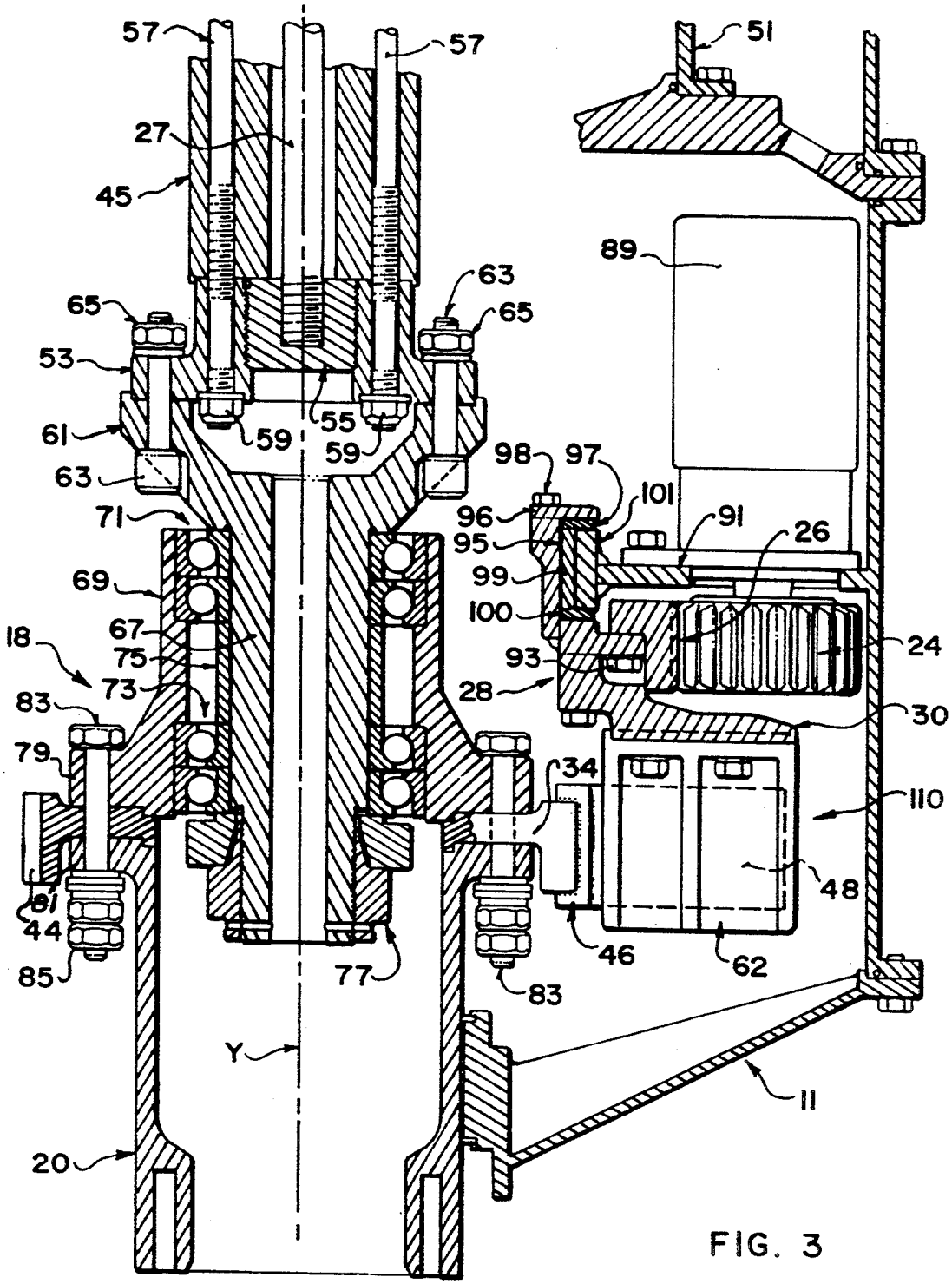
FIG. 3 is an enlarged sectional view of the coupling and bearing thereof and adjacent components.

The vibrator has a flange 39 on the bottom thereof which is mounted on a corresponding flange 41 of a shaft 45 by means of a plurality of bolts 43. The shaft 45 has a integral piston 47, shown in FIG. 2 only, which forms part of a dashpot assembly 49 shown best in FIG. 2. The piston is received reciprocatingly within a cylindrical housing 51 which guides the vertical, sonic vibrations. The housing is pressurized with air on both sides of the piston. There is a flange 53 on the bottom of shaft 45. As best seen in FIG. 3, shaft 45 is hollow and tensioning bolt 27 extends to the bottom thereof and is threadedly received in insert 55 of flange 53. A plurality of assembly bolts 57 and nuts 59 connect the shaft 45 to the flange 53. The nut 29, shown in FIG. 1 and 2, is tightened to hold all of the components between the nut and flange 53 tightly together to resist separation due to the sonic vibrations.

Flange 53 is connected to flange 61 of bearing assembly 18, shown best in FIG. 3, by a plurality of bolts 63 and nuts 65. The bearing assembly is disclosed in my earlier U.S. Pat. No. 5,027,908 and therefore is described only briefly here. There is an inner, shaft-like member 67 within an annular member 69. The member 69 is rotatably supported on member 67 by two pairs of angular contact roller bearings 71 and 73. A sleeve-like spacer 75 is located between the pairs of ball bearings. A nut 77 is tightened to tension the assembly.

Member 69 has a bottom flange 79 connected by bolts 83 and nuts 85 to top flange 81 of hollow shaft 20 which is connected to drill string 22 below.

The cranks 15 in FIG. 2 are rotated by hydraulic motor 120 coupled to a shaft 122 by gears 124 and 126 as seen in FIG. 2. Shaft 122 has a splined socket 128 which receives a splined ball 130 on shaft 123 connected to crank 15. There is a splined ball and socket joint 125 on the opposite end of shaft 123. The splined balls and sockets joint allow vertical movement of the crank as the vibrator vibrates.

Rotation of the drill string is accomplished by means of three hydraulic motors in this example, two motors 87 and 89 being shown in FIG. 1. Each motor is connected to one of three pinions 24. The motors are mounted on an internal flange 91 of container 11. The pinions engage a ring gear 26, shown best in FIG. 1, mounted on an annular member 28 by bolts 93.

The member 28 has an outwardly facing annular channel 95, adjacent the top thereof faced by three brass bushings 97, 99 and 100 as seen in FIG. 3. The bushings serve to rotatably mount member 28 on an annular member 101 mounted on flange 91. A cap 96 is mounted on the top of member 28 by a plurality of bolts 98.

Figures 4, 5, 6:
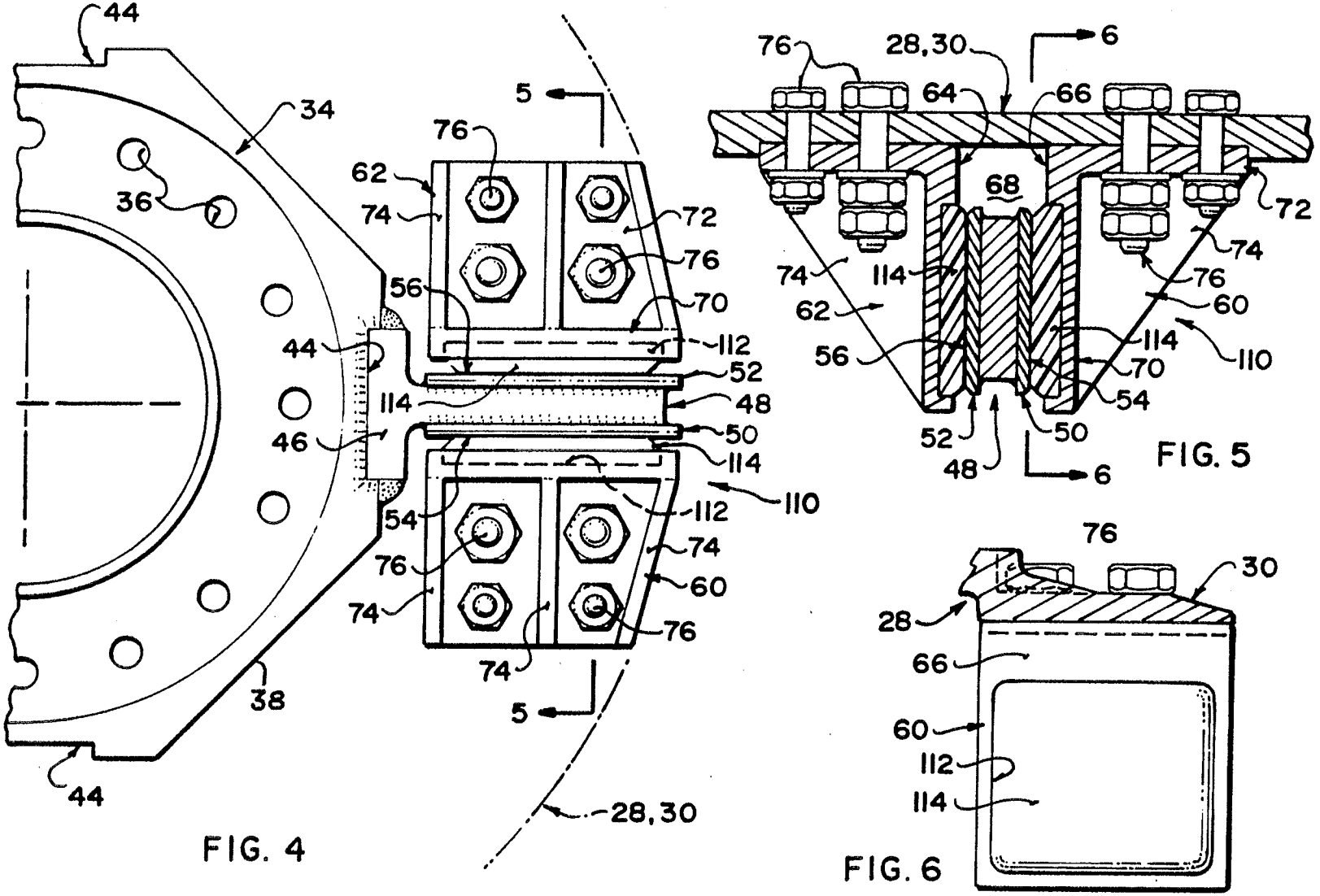
FIG. 4 is fragmentary bottom plan of the coupling.
FIG. 5 is a sectional view taken along line 5—5 of FIG. 4.
FIG. 6 is a sectional view taken along line 6—6 of FIG. 5.

An annular member 34 is received between flange 79 of member 69 and flange 81 of shaft 20. The member 34 is shown better in FIG. 4 and includes a series of spaced-apart bolt holes 36 about the periphery thereof. These bolt holes align with corresponding bolt holes in flanges 79 and 81 to accommodate bolts 83 and nuts 85 which connect together the flanges and the member 34. There are four angularly spaced-apart, relatively broad slots 44 located about outer edge 38 of member 34, only three of which are shown in FIG. 4. These are 90° apart. Each of the slots receives a T-shaped member 46 which is welded to member 34 in this example although other connection means could be employed. These T-shaped members form projections which extend radially outwards from member 34, the projections having blade-shaped portions 48. There could be a greater or smaller number of projections and the angular spacing need not be equal.

Each of the blade-shaped portions 48 has a pair of plates 50 and 52 on either side thereof as seen in FIG. 4. These are rectangular in shape in this particular example and have flat sides 54 and 56.

Member 28 connected to the ring gear 26 has a mount 30 for a plurality of angularly spaced-apart pairs of blade-engaging, support members 110, each having two halves 60 and 62. As seen best in FIG. 5, the halves 60 and 62 have radially extending surfaces 64 and 66 which are opposed and spaced-apart to form a slot 68 therebetween. Each surface has a rectangular pocket 112 which receives an antifriction lining 114. The linings in this example are of glass fiber reinforced polytetrafluoethylene (PTFE) although other suitable lining materials could be substituted. Each half 60 and 62 of each member 110 is in the form of a bracket with two perpendicular sides 70 and 72 and three triangular gusset members 74 extending therebetween. Bolts 76 connect each of the halves of member 110 to member 28.

In this particular example there are four members 110 which are spaced-apart 90° apart and positioned to correspond with the positions of members 46 on member 34. As seen in FIG. 1 and FIG. 4, the blade-shaped portions 48 are received slidably within the slots 68 between the anti-friction linings 114 on the halves 60 and 62 of members 110. Thus, the members 34 and 28 form a coupling for engaging the rotary drive mechanism, including the hydraulic motors 87 and 89 and gears 24 and 26, to the drill string 22 as shown by arrow B. At the same time, because of the slidable fit between the anti-friction linings 114 and the plates 50 and 52 on the portions 48 of members 46, vertical movement of the drill string is permitted to accommodate the sonic vibrations imparted by sonic vibrator 12. All of the components of the coupling are sealed in the drum like container 11 in this embodiment and immersed in an oil bath to a level generally near that of 92 in FIG. 2. There are no linkages to break as in the prior art and the anti-friction linings prevent welding which occurs when metal components are in contact. The larger surfaces of the pad-like sliding components reduces stresses encountered in the prior art.

In alternative embodiments, the blade-shaped members could be mounted on the ring gear and slots on a member mounted on the drill string. The anti-friction linings could also be on the blades.

It will be understood by someone skilled in the art that many of the details above are given by way of example only and are not intended to limit the scope of the invention which is to be interpreted with reference to the following claims.

What is claimed is:

1. In combination:

a sonic vibrating unit;

a rotary drive unit;

a first coupling member operatively connected to the rotary drive unit, the first coupling member having a plurality of spaced-apart pairs of supports connected thereto, each said support having a radially extending surface, the surfaces of each said pair of supports being spaced-apart, each said surface having an anti-friction lining mounted thereon;

a drill string connected to the sonic vibrating unit; and a second coupling member operatively connected to the drill string and having a plurality of spaced-apart blade-shaped members extending radially outwards therefrom, each said blade-shaped member having opposite sides, each said blade-shaped member being slidably received between one said pair of supports of the first coupling member to engage the drill string with the rotary drive unit.

2. A combination as claimed in claim 1, wherein the anti-friction lining are glass-fiber reinforced PTFE.

3. A combination as claimed in claim 1, wherein there are four blade-shaped members and four pairs of supports.

4. A combination as claimed in claim 1, wherein the supports are brackets with two perpendicular sides.

5. A combination as claimed in claim 1, wherein the coupling members are within an oil-tight chamber.

6. A combination as claimed in claim 1, wherein the rotary drive unit includes a stationary support having an annular member, the first coupling member having an outwardly facing annular groove rotatably received on the annular member.

7. A combination as claimed in claim 6, wherein the rotary drive unit includes a ring gear mounted on the first coupling member.

* * * * *